US008887375B2

(12) United States Patent
Xiong et al.

(10) Patent No.: US 8,887,375 B2
(45) Date of Patent: Nov. 18, 2014

(54) METHOD FOR MANUFACTURING EARPHONE

(75) Inventors: Yi Xiong, Shenzhen (CN); Zhi-Hua Lin, Shenzhen (CN); Hai-Bing Jiang, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 110 days.

(21) Appl. No.: 13/451,781

(22) Filed: Apr. 20, 2012

(65) Prior Publication Data

US 2013/0034259 A1 Feb. 7, 2013

(30) Foreign Application Priority Data

Aug. 4, 2011 (CN) ..... 2011 1 0221959

(51) Int. Cl.
*H04R 31/00* (2006.01)
*H04R 1/10* (2006.01)

(52) U.S. Cl.
CPC . *H04R 1/10* (2013.01); *H04R 31/00* (2013.01)
USPC ..... 29/594; 29/592.1; 29/609.1; 381/368; 381/369

(58) Field of Classification Search
USPC ..... 29/592.1, 594, 609, 609.1; 381/170, 381/313, 355, 356, 358, 360, 361, 368, 369, 381/380
See application file for complete search history.

(56) References Cited

U.S. PATENT DOCUMENTS

| | | | | |
|---|---|---|---|---|
| 4,163,877 | A * | 8/1979 | Schonstedt | 324/226 |
| 6,427,018 | B1 * | 7/2002 | Keliiliki | 381/381 |
| 6,772,853 | B2 * | 8/2004 | Yang | 181/129 |
| 6,829,365 | B1 * | 12/2004 | Kim | 381/370 |
| 7,116,795 | B2 * | 10/2006 | Tuason et al. | 381/386 |
| 7,231,056 | B2 * | 6/2007 | Chen | 381/381 |
| 7,251,335 | B1 * | 7/2007 | Chen | 381/71.6 |
| 7,356,362 | B2 * | 4/2008 | Chang et al. | 455/575.2 |
| 7,499,562 | B2 * | 3/2009 | Shim | 381/382 |
| 7,858,897 | B2 * | 12/2010 | Beranger | 219/121.14 |
| 7,971,338 | B2 * | 7/2011 | Yang et al. | 29/594 |
| 2003/0002706 | A1 * | 1/2003 | Keliiliki | 381/381 |
| 2006/0159279 | A1 * | 7/2006 | Kuo et al. | 381/74 |
| 2006/0281502 | A1 * | 12/2006 | Chang et al. | 455/575.2 |
| 2008/0119244 | A1 * | 5/2008 | Malhotra | 455/575.1 |
| 2009/0233652 | A1 * | 9/2009 | Yang | 455/569.1 |
| 2009/0279731 | A1 * | 11/2009 | Wu | 381/386 |
| 2011/0159229 | A1 * | 6/2011 | Doehle et al. | 428/81 |
| 2013/0251186 | A1 * | 9/2013 | Matsuo et al. | 381/380 |

FOREIGN PATENT DOCUMENTS

| | | | |
|---|---|---|---|
| CN | 1875194 | A | 12/2006 |
| CN | 201585105 | U | 9/2010 |

* cited by examiner

*Primary Examiner* — Paul D Kim
(74) *Attorney, Agent, or Firm* — Novak Druce Connolly Bove + Quigg LLP

(57) ABSTRACT

An earphone includes an earphone housing, a speaker positioned in the earphone, and an earphone cable connected to the speaker. The earphone housing has a first housing and a second housing. The first housing forms a first connecting surface, and the second housing forms a second connecting surface. The first connecting surface and the second connecting surface abut against each other and are ultrasonically fused together, in which excess plastic is formed and arranged along a fusing line. A method of manufacturing above-described earphone is also provided. The method also includes the forming of an excess plastic arranged along a fusing line formed between the first housing and the second housing made during ultrasonic fusion, the removing of excess plastic of the earphone phone by a cutter, and the grinding of the earphone housing by a grinding device.

7 Claims, 8 Drawing Sheets

METHOD FOR MANUFACTURING EARPHONE

BACKGROUND

1. Technical Field

The present disclosure generally relates to earphones, and particularly, to an earphone formed by ultrasonic fusion.

2. Description of the Related Art

An earphone includes an earphone housing, a speaker positioned in the earphone housing, and an earphone cable electrically connected to the speaker. The earphone housing includes a front housing and a back housing glued/engaged to the front housing. However, if the back housing is glued to the front housing, the back housing is easily separated from the front housing due to having low bonding strength between the back housing and the front housing. Meanwhile, if the back housing is engaged to the front housing, the back housing and the front housing require the machining of a special engaging structure, and thus manufacturing costs of the earphone is thereby increased.

Therefore, there is room for improvement within the art.

BRIEF DESCRIPTION OF THE DRAWING

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
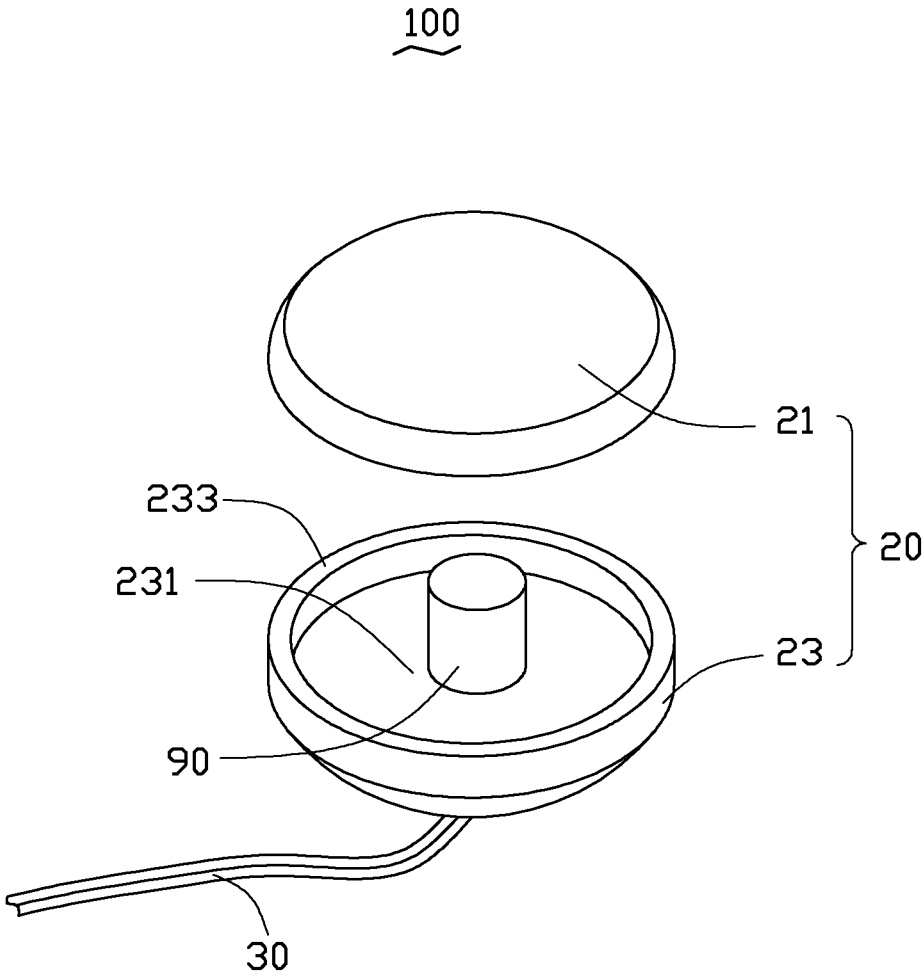
FIG. 1 is an isometric, exploded view of a first embodiment of an earphone.

Referring to FIG. 1, a first embodiment of an earphone 100 includes an earphone housing 20, a speaker 90 positioned in the earphone housing 20, and an earphone cable 30 electrically connected to the speaker 90.

Figure 2:
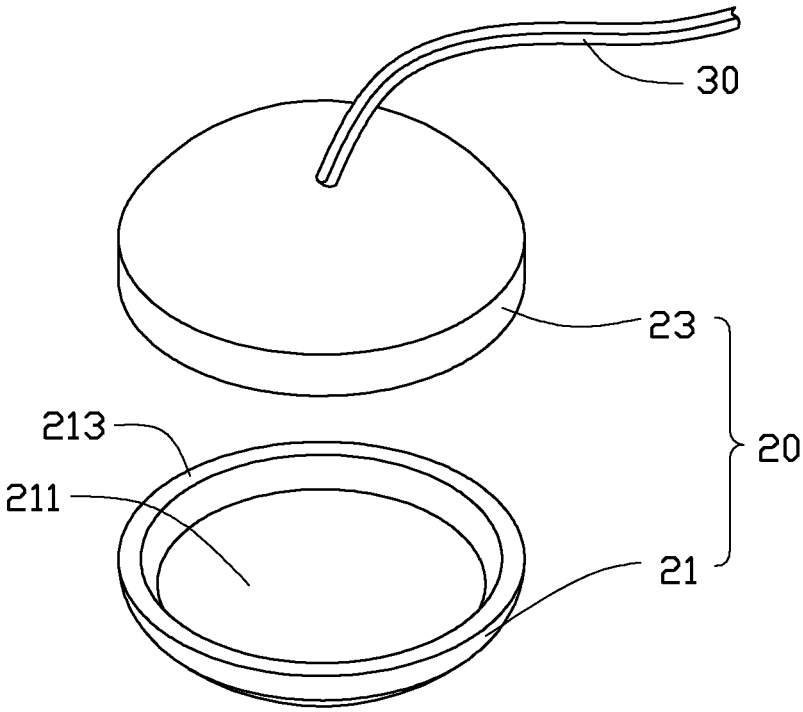
FIG. 2 is similar to FIG. 1, but viewed from another aspect.

Referring to FIG. 2, the earphone housing 20 includes a first housing 21 and a second housing 23. The first housing 21 is hemi-spherical and defines a first receiving groove 211. The first housing 21 forms a first connecting surface 213. The second housing 23 is hemi-spherical and defines a second receiving groove 231. The second housing 23 forms a second connecting surface 233. In the illustrated embodiment, the first housing 21 and the second housing 23 are made of a plastic material.

Figure 3:
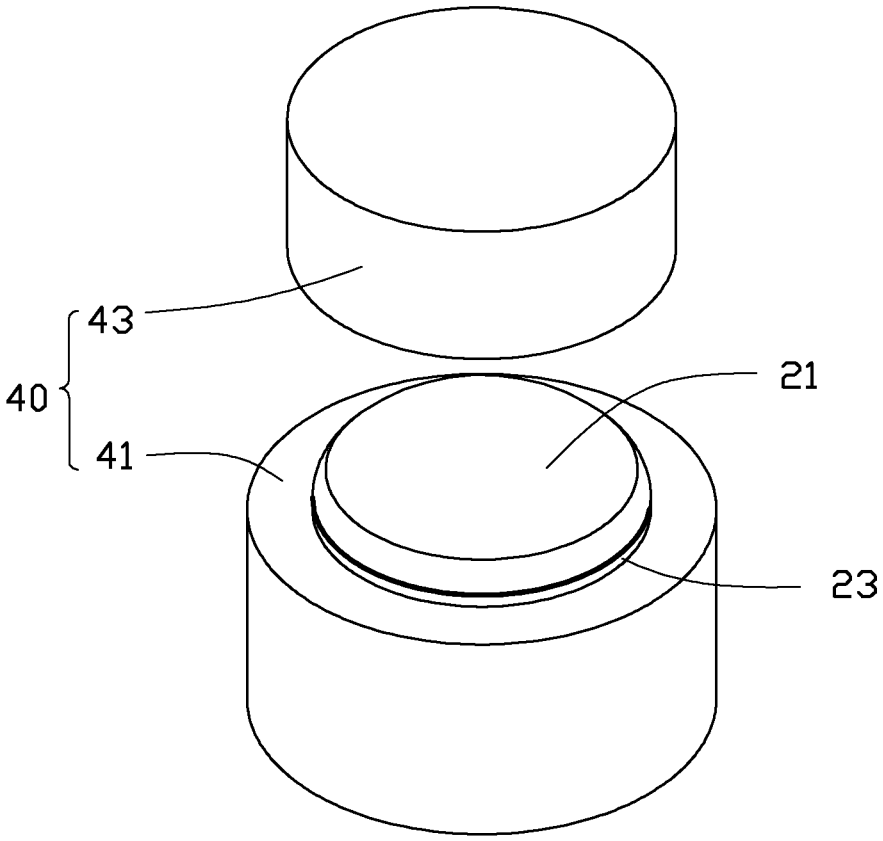
FIG. 3 is an isometric view of an ultrasonic fusion device for fusing the earphone of FIG. 1.

Referring to FIG. 3, the first housing 21 is positioned on the second housing 23, with the second connecting surface 233 abutting the first connecting surface 213. The first housing 21 and the second housing 23 are fused together by an ultrasonic fusion device 40.

The ultrasonic fusion device 40 includes a positioning frame 41 and a fusing head 43. The positioning frame 41 defines a positioning groove (not labeled) in a top surface thereof. The second housing 23 is disposed in the positioning groove of the positioning frame 41, and the second connecting surface 233 is above the positioning frame 41. The fusing head 43 may also define an assembly groove (not labeled) for partially receiving the first housing 21.

Figure 4:
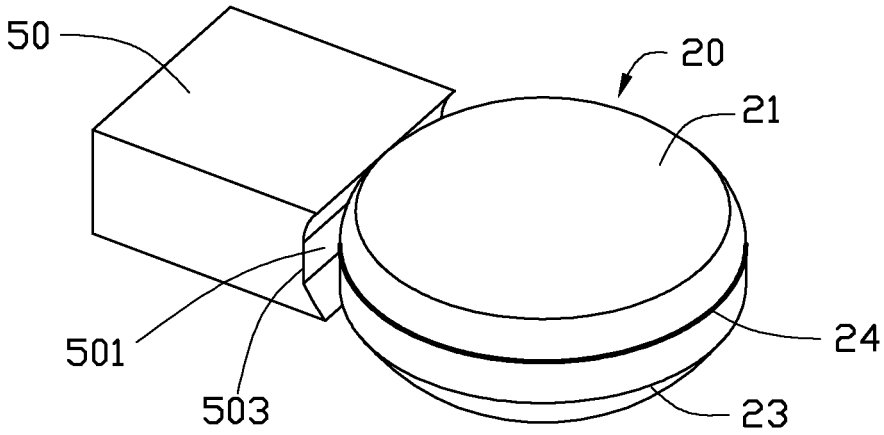
FIG. 4 is an isometric view of a cutter cutting the earphone of FIG. 1.

Referring to FIG. 4, after the first housing 21 and the second housing 23 are fused together to form the earphone housing 20, a fusing line 24 is formed between the first housing 21 and the second housing 23, and an amount of excess plastic is formed and arranged along the fusing line 24. A cutter 50 includes a profiling surface 501 and a cutting edge 503 formed at a side of the profiling surface 501. The profiling surface 501 is matched with the outer surface of the earphone housing 20, and the cutting edge 503 cuts off the excess plastic along the fusing line 24.

Figure 5:
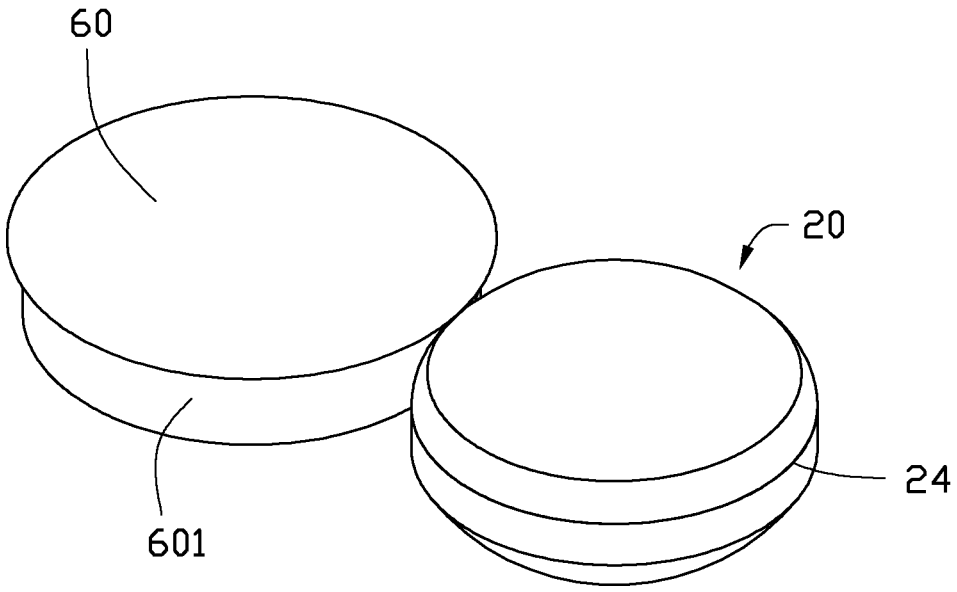
FIG. 5 is an isometric view of a grinding device grinding the earphone of FIG. 1.
Figure 6:
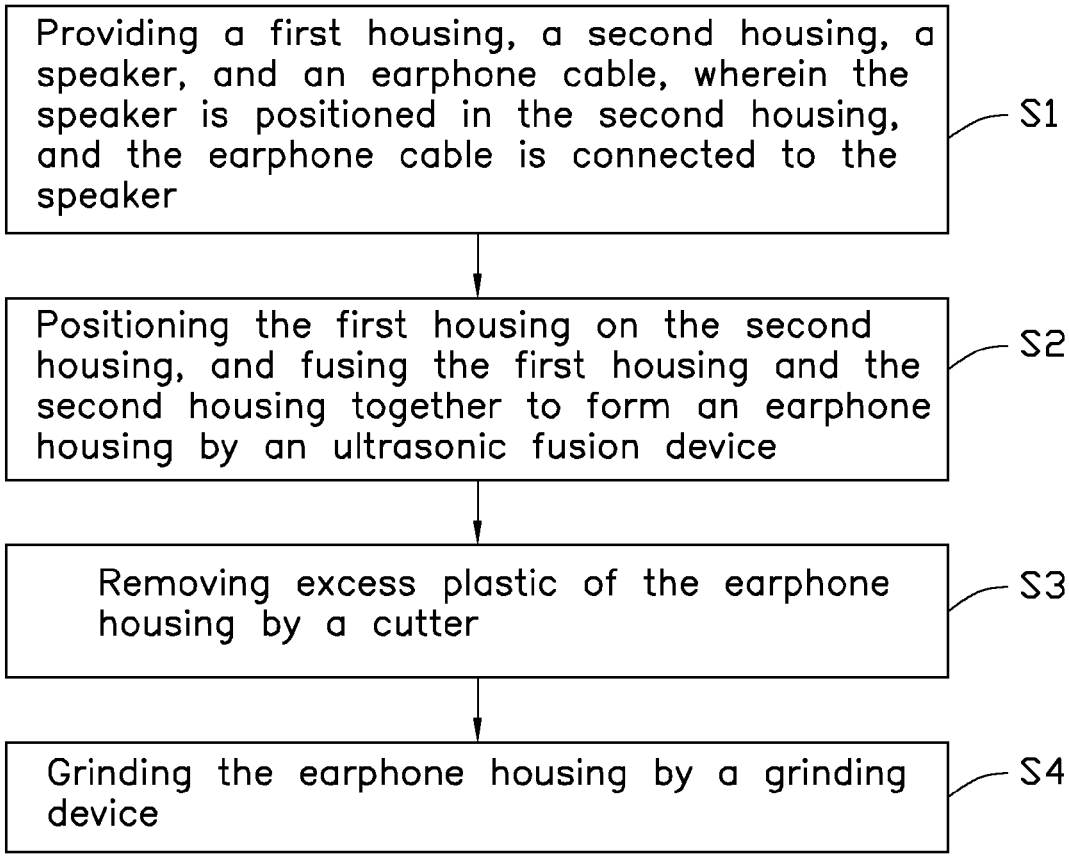
FIG. 6 is a flow chart of a method for manufacturing an earphone.

Referring to FIG. 5, after the excess plastic has been removed by the cutter 50, the earphone housing 20 is ground by a grinding device 60. The grinding device 60 forms a grinding surface 601 matching the side surface of the earphone housing 20 along the fusing line 24. In the illustrated embodiment, the grinding device 60 is a polishing wheel.

Referring to FIGS. 2 through 6, a method of manufacturing the earphone 100 of the first embodiment is described as follows. In a step S1, the first housing 21, the second housing 23, the speaker 90, and the earphone cable 30 are provided. In the illustrated embodiment, the speaker 90 is positioned in the second housing 23, and the earphone cable 30 extends through the second housing 23 to electrically connect to the speaker 90.

In a step S2, the first housing 21 is fused to the second housing 23 by the ultrasonic fusion device 40. In the illustrated embodiment, the second housing 23 is positioned in the positioning frame 41, and the first housing 21 is positioned on the second housing 23 to seal the speaker 90, with the first connecting surface 213 abutting the second connecting surface 233. The fusing head 43 presses on the first housing 21, and fuses the first housing 21 and the second housing 23 together to form the earphone housing 20. A fusing line 24 is formed between the first housing 21 and the second housing 23 after fusing, and an amount of excess plastic is formed to be arranged along the fusing line 24.

In a step S3, the excess plastic of the earphone housing 20 is removed by the cutter 50. In the illustrated embodiment, the earphone housing 20 is rotated, and the cutter 50 is moved along the fusing line 24 to remove the excess plastic.

In a step S4, the earphone housing 20 is ground by the grinding device 60. In the illustrated embodiment, the grinding surface 601 of the grinding device 60 touches the side surface of the earphone housing 20. The earphone housing 20 is rotated clockwise, and the grinding device 60 is rotated counterclockwise along the fusing line 24.

Figure 7:
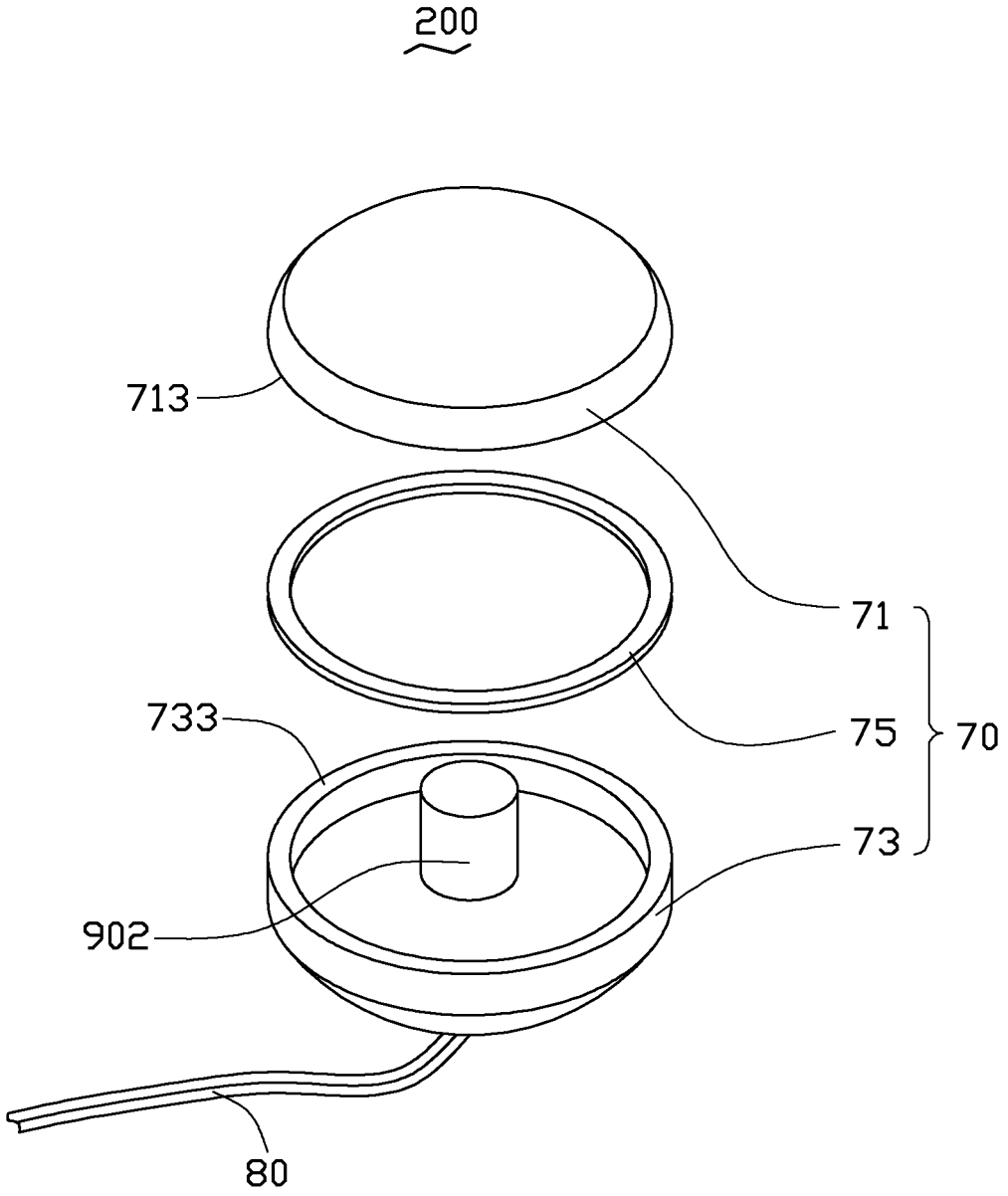
FIG. 7 is an isometric, exploded view of a second embodiment of an earphone.

Referring to FIG. 7, a second embodiment of an earphone 200 is similar to the earphone 100 of the first embodiment, except that a soft plastic piece 75 is positioned on the second housing before the first housing is positioned on the second housing. Thus the soft plastic piece 75 is positioned between the first connecting surface 713 of the first housing 71 and the second connecting surface 733 of the second housing 73. In the illustrated embodiment, the soft plastic piece 75 is annular.

The positioning of the soft plastic piece 75 between the first housing 71 and the second housing 73, while the fusing head 43 applies a pressing force on the first housing 21, alleviates and spreads the pressing force between the first housing 71 and the second housing 73 during ultrasonic fusion. Therefore, the first housing 71 and the second housing 73 can be more accurately fused together. Furthermore, the earphone 200 having the soft plastic piece 75 is less rigid, and thus users obtain a comfortable feeling from the additional resiliency of the earphone housing 200.

Figure 8:
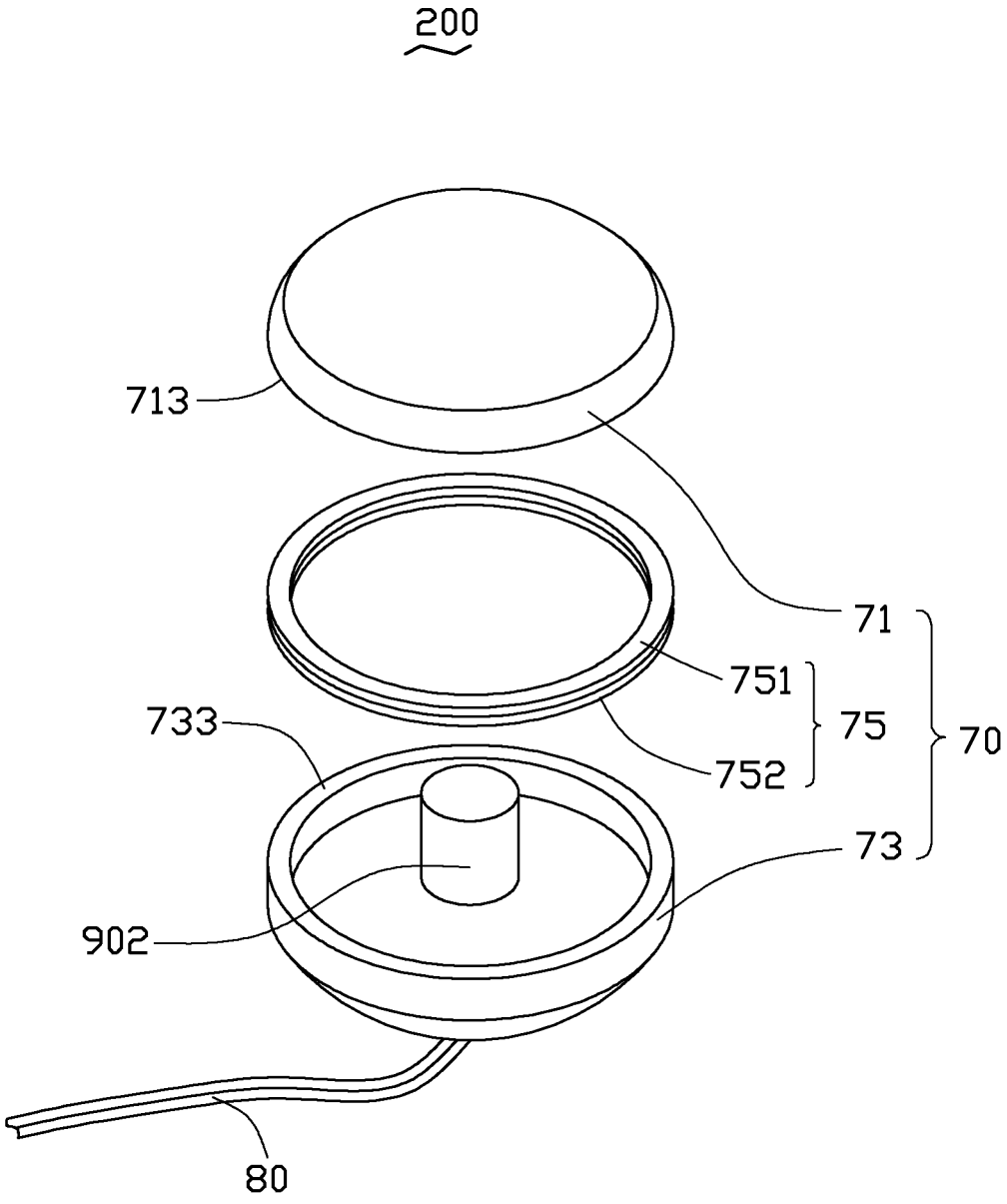
FIG. 8 is an isometric, exploded view of another embodiment of an earphone.

Referring to FIG. 8, in an alternative embodiment, the first housing 71 is made of a first plastic material and the second housing 73 is made of a second plastic material. The soft plastic piece 75 including a first plastic layer 751 made of the first plastic material and a second plastic layer 752 made of the second plastic material is formed by double-shot molding. In the fusion of the first housing 71 and the second housing 73, the first plastic layer 751 is attached to the first housing 71, and the second plastic layer 752 is attached to the second housing 73. The first plastic layer 751 and the first housing 71 being made of the same first plastic material, and the second plastic layer 752 and the second housing 73 being made of the same second plastic material, results in an improvement of the fusion-bonding quality between the first housing 71 and the second housing 73.

While the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure, as defined by the appended claims.

What is claimed is:

1. A method of manufacturing an earphone, comprising:

providing a first housing, a second housing, a soft plastic piece, a speaker, and an earphone cable, wherein the soft plastic piece is positioned on the second housing, the speaker is positioned in the second housing, and the earphone cable is connected to the speaker;

positioning the first housing on the second housing, and fusing the first housing and the second housing together to form an earphone housing by an ultrasonic fusion device, wherein the soft plastic piece is located between the first housing and the second housing;

removing an excess plastic of the earphone housing by a cutter; and grinding the earphone housing by a grinding device.

2. The method of manufacturing the earphone of claim 1, wherein in the step of positioning the first housing on the second housing, the ultrasonic fusion device comprises a positioning frame and a fusing head, the second housing is disposed in the positioning frame, and the fusing head presses the first housing to abut against the second housing.

3. The method of manufacturing the earphone of claim 2, wherein after the first housing and the second housing are fused together, a fusing line is formed between the first housing and the second housing, and the excess plastic is formed and arranged along the fusing line.

4. The method of manufacturing the earphone of claim 3, wherein the cutter comprises a profiling surface and a cutting edge formed at a side of the profiling surface, in the step of removing excess plastic of the earphone housing by the cutter, the cutting edge cuts the excess plastic along the fusing line.

5. The method of manufacturing the earphone of claim 4, wherein in the step of grinding the earphone housing by the grinding device, the grinding device forms a grinding surface matching a side surface of the earphone housing along the fusing line.

6. The method of manufacturing the earphone of claim 5, wherein the grinding device is a polishing wheel.

7. A method of manufacturing an earphone, comprising:

providing a first housing, a second housing, a speaker, an ultrasonic fusion device, and an earphone cable, wherein the speaker is positioned in the second housing, and the earphone cable is connected to the speaker, the ultrasonic fusion device comprises a positioning frame and a fusing head;

disposing the second housing in the positioning frame, and pressing the first housing to abut against the second housing with the fusing head, wherein the first housing and the second housing is fused together to form an earphone housing;

removing an excess plastic of the earphone housing by a cutter; and grinding the earphone housing by a grinding device.

* * * * *